US010433063B2

(12) United States Patent
Rusconi Clerici Beltrami et al.

(10) Patent No.: US 10,433,063 B2
(45) Date of Patent: Oct. 1, 2019

(54) MEMS CIRCUIT BOARD MODULE HAVING AN INTEGRATED PIEZOELECTRIC STRUCTURE, AND ELECTROACOUSTIC TRANSDUCER ARRANGEMENT

(71) Applicant: USOUND GMBH, Graz (AT)

(72) Inventors: Andrea Rusconi Clerici Beltrami, Vienna (AT); Ferruccio Bottoni, Graz (AT)

(73) Assignee: USound GmbH, Graz (AT)

( * ) Notice: Subject to any disclaimer, the term of this patent is extended or adjusted under 35 U.S.C. 154(b) by 0 days.

(21) Appl. No.: 15/758,070

(22) PCT Filed: Sep. 5, 2016

(86) PCT No.: PCT/EP2016/070796
§ 371 (c)(1),
(2) Date: Mar. 7, 2018

(87) PCT Pub. No.: WO2017/055012
PCT Pub. Date: Apr. 6, 2017

(65) Prior Publication Data

US 2018/0249252 A1 Aug. 30, 2018

(30) Foreign Application Priority Data

Oct. 1, 2015 (DE) ..... 10 2015 116 640

(51) Int. Cl.
*H04R 7/10* (2006.01)
*H04R 17/00* (2006.01)
(Continued)

(52) U.S. Cl.
CPC ..... *H04R 7/10* (2013.01); *H04R 3/00* (2013.01); *H04R 17/00* (2013.01); *H04R 19/005* (2013.01); *H04R 2201/003* (2013.01)

(58) Field of Classification Search
CPC ..... H04R 1/22; H04R 2499/11; H04R 7/04; H04R 7/06; H04R 9/06; H04R 7/10;
(Continued)

(56) References Cited

U.S. PATENT DOCUMENTS 8,520,868 B2 8/2013 Jeong et al.
9,309,105 B2 4/2016 Dehe et al.
(Continued)

FOREIGN PATENT DOCUMENTS

DE 102010005654 7/2011
DE 102013114826 6/2015
(Continued)

OTHER PUBLICATIONS

Translation of the International Preliminary Report on Patentability (PCT/EP2016/070796), dated Apr. 12, 2018.
(Continued)

*Primary Examiner* — Curtis A Kuntz
*Assistant Examiner* — Julie X Dang
(74) *Attorney, Agent, or Firm* — Dority & Manning, P.A.

(57) ABSTRACT

The invention relates to a MEMS printed circuit board module (1) for a sound transducer assembly (2) for generating and/or detecting surge waves in the audible wavelength spectrum with a printed circuit board (4) and a multi-layer piezoelectric structure (5), by means of which a membrane (6) provided for this purpose can be set into oscillation and/or oscillations of a membrane (6) can be detected. In accordance with the invention, the multi-layer piezoelectric structure (5) is directly connected to the printed circuit board (4). In addition, the invention relates to a sound transducer assembly (2) with such a MEMS printed circuit board module (1) along with a method for the manufacturing of the MEMS printed circuit board module (1) and the sound transducer assembly (2).

20 Claims, 4 Drawing Sheets

(51) Int. Cl.
*H04R 3/00* (2006.01)
*H04R 19/00* (2006.01)

(58) Field of Classification Search
CPC ..... H04R 3/00; H04R 17/00; H04R 19/005; H04R 2201/003; G01L 1/16; G01L 9/008; G01P 15/0802; G01P 15/09; G01P 15/0922; G10K 9/122
USPC ..... 381/190, 174–175; 310/339, 370; 367/140
See application file for complete search history.

(56) References Cited

U.S. PATENT DOCUMENTS

| | | | | |
|---|---|---|---|---|
| 9,980,051 | B2 | 5/2018 | Clerici et al. | |
| 2005/0023931 | A1* | 2/2005 | Bouche | H03H 9/175 310/327 |
| 2010/0181871 | A1* | 7/2010 | Daniel | G01L 1/16 310/338 |
| 2011/0085684 | A1 | 4/2011 | Kim et al. | |
| 2011/0176392 | A1* | 7/2011 | Fluhrer | G10K 9/122 367/140 |
| 2014/0270307 | A1* | 9/2014 | Yu | H04R 7/06 381/337 |
| 2015/0070864 | A1* | 3/2015 | Rainer | H01L 21/563 361/782 |
| 2017/0006381 | A1 | 1/2017 | Rusconi Clerici et al. | |
| 2017/0085994 | A1 | 3/2017 | Clerici et al. | |
| 2017/0094418 | A1 | 3/2017 | Clerici et al. | |

FOREIGN PATENT DOCUMENTS

| | | | |
|---|---|---|---|
| DE | 102015103059 | 9/2015 | |
| DE | 102014106753 | 11/2015 | |
| WO | WO 2015/173333 | 11/2015 | |
| WO | WO 2015/173334 | 11/2015 | |
| WO | WO-2017055012 A1 * | 4/2017 | H04R 7/10 |

OTHER PUBLICATIONS

German Patent Office Search Report (10 2015116640.2), dated Jun. 24, 2016.
International Search Report (PCT/EP2016/070796), dated Nov. 18, 2016.

* cited by examiner

MEMS CIRCUIT BOARD MODULE HAVING AN INTEGRATED PIEZOELECTRIC STRUCTURE, AND ELECTROACOUSTIC TRANSDUCER ARRANGEMENT

FIELD OF THE INVENTION

The present invention relates to a MEMS printed circuit board module for a sound transducer assembly for generating and/or detecting sound waves in the audible wavelength spectrum, with a printed circuit board and a multi-layer piezoelectric structure, by means of which a membrane provided for this purpose can be set into oscillation and/or oscillations of a membrane can be detected. Furthermore, the invention relates to a sound transducer assembly that includes the MEMS printed circuit board module and a membrane. In addition, the invention relates to a manufacturing method for a corresponding MEMS printed circuit board module and/or a corresponding sound transducer assembly.

BACKGROUND

The term "MEMS" stands for microelectromechanical systems. The term "cavity" is to be understood as an empty space by means of which the sound pressure of the MEMS sound transducer can be reinforced. Such systems are particularly installed in electronic devices that offer little space, but must withstand high loads. DE 10 2013 114 826 discloses a MEMS sound transducer for generating and/or detecting sound waves in the audible wavelength spectrum with a carrier substrate, a hollow space formed in the carrier substrate and a multi-layer piezoelectric membrane structure. In such MEMS sound transducers, a silicon semiconductor is used as the material for carrier substrates. In such MEMS sound transducers, a silicon semiconductor is used as the material for carrier substrates.

OBJECTS AND SUMMARY OF INVENTION

As such, the task of the present invention to provide a MEMS printed circuit board module, a sound transducer assembly and a manufacturing method, such that manufacturing costs can be reduced.

The task is solved by a MEMS printed circuit board module, a sound transducer assembly and a manufacturing method according to the independent patent claims.

A MEMS printed circuit board module for a sound transducer assembly for generating and/or detecting sound waves in the audible wavelength spectrum is proposed. The MEMS board module includes a printed circuit board. The printed circuit board is preferably made of an electrically insulating material and preferably comprises at least one electrical conductive layer. In addition to the printed circuit board, the MEMS circuit board module includes a structure. The structure is multi-layered and designed to be piezoelectric. By means of this structure, a membrane provided for this purpose can be set into oscillation. Alternatively or in addition, oscillations of the membrane can be detected by means of the piezoelectric structure. Accordingly, the structure acts as an actuator and/or sensor. The multi-layer piezoelectric structure is directly connected to the printed circuit board. Herein, it is preferable that at least one layer of the structure is formed by the conductive layer of the printed circuit board.

Through this integrative design of the structure in the printed circuit board, the proposed MEMS printed circuit board module can be easily and inexpensively manufactured. In this manner, it is also possible to embed electrical components directly into the printed circuit board and to connect them with the components provided for this purpose, such as the structure, solely by means of simple plated through-holes.

Likewise, the proposed MEMS printed circuit board module can be formed in a highly space-saving manner through the at least partially integrative design of the structure in the printed circuit board, since additional components, in particular additional carrier substrates, can be spared. In addition, the use of a corresponding printed circuit board technology results in considerable cost savings, since the high cost factor of the expensive silicon for the carrier substrate is eliminated. Likewise, in this manner, larger speakers, even those larger in size (where necessary), can be manufactured inexpensively.

It is advantageous if the printed circuit board is designed as a structural support, in particular as a support frame, of the structure. Thus, the structure, which preferably comprises at least one cantilever, can be deflected relative to the printed circuit board along a lifting axis or z-axis. Accordingly, the structural support serves as a base or support element for the structure that can be deflected relative to it.

Furthermore, it is advantageous in this connection if the printed circuit board features a recess. The recess preferably extends completely through the printed circuit board. The structure is arranged on the front side in the area of an opening of the recess. Alternatively, the structure is arranged inside the recess. Preferably, the recess extends along the z-axis or lifting axis, in the direction of which the membrane provided for this purpose is able to oscillate. In this manner, the recess at least partially forms a cavity of the sound transducer assembly. Thus, the MEMS printed circuit board module can be formed in a highly space-saving manner, since additional components, in particular additional housing parts, can be dimensioned to be smaller for the complete design of the cavity or even completely spared. The volume of the cavity can be adjusted to the individual application by increasing the size of the recess in the printed circuit board itself, if a higher sound pressure is required. Likewise, the recess may be closed by the printed circuit board itself or by a housing part. The cavity of the sound transducer assembly can be rapidly, easily and inexpensively adjusted to the particular application by means of the recess.

In addition, it is advantageous if the structure is firmly connected to the printed circuit board in an anchoring area turned towards the printed circuit board, in particular by means of lamination. Alternatively or in addition, the structure is embedded in the printed circuit board and/or laminated in its anchoring area. Thus, during the manufacturing process of the printed circuit board, the structure can be cost-effectively integrated into it. Thus, previous manufacturing steps for connecting the membrane to a silicon substrate can be eliminated. If the structure is embedded in the printed circuit board, its anchoring area is connected (in particular, glued) from at least two sides (that is, at least from the top and the bottom) to the printed circuit board, in particular to the respective corresponding layers of the printed circuit board.

It is advantageous if the structure is an actuator structure. The actuator structure is preferably formed from at least one piezoelectric layer. If the sound transducer arrangement for which the MEMS printed circuit board module is provided functions as a loudspeaker (for example), the actuator structure can be excited in such a manner that a membrane provided for this purpose is set into oscillation for generating sound energy. On the other hand, if the sound transducer assembly functions as a microphone, the oscillations are converted into electrical signals by the actuator structure. Thus, the actuator structure can be individually and inexpensively adjusted to different requirements, in particular by means of an application-specific integrated circuit (ASIC).

Alternatively or in addition, it is advantageous if the structure is a sensor structure. At this, the sensor structure preferably forms a position sensor, by means of which the deflection of a membrane provided for this purpose can be detected and evaluated. Based on the evaluation, the actuator structure can be driven in a controlled manner, such that the membrane is deflected depending on the circumstances. In this manner, compensation can be provided for external influences and aging effects.

Alternatively or in addition, it is advantageous if the structure comprises at least one support layer made of metal, in particular copper. The support layer preferably features a thickness of 1 to 50 μm. Due to the electrically conductive support layer, the electronic components of the MEMS board module can be connected to each other. By using the very fine support layer, the structure formed to be highly compact.

Furthermore, it is advantageous if the printed circuit board is a multi-layer fiber composite component. At this, the printed circuit board features several layers of electrically insulating material. Electrical conductive layers made of copper, which can be connected to each other by means of plated through-holes, are arranged between the insulating layers. Since the structure is directly connected to the printed circuit board, the connections necessary for the functioning of the MEMS printed circuit board module can be realized in a cost-effective and space-saving manner through such a printed circuit board.

In addition or alternatively, it is advantageous if the printed circuit board is a laminated fiber composite component. In this manner, a printed circuit board is formed, whose individual layers are stably connected to each other in such a manner that the functionality of the system is ensured, even upon shocks or other external influences.

Alternatively or in addition, it is advantageous if the printed circuit board comprises at least one electrically conductive layer made of metal. In order to connect the printed circuit board to the structure compactly and without additional components, it is advantageous if the electrical conductive layer forms the support layer of the structure.

It is further advantageous if the structure features at least one piezoelectric layer, which is preferably electrically coupled to the support layer. Thus, the mechanical movement of the structure necessary for the deflection of the membrane can be easily realized, since the electrical voltage of the support layer can be used directly and without additional contacts of the piezoelectric layer. Likewise, an electrical voltage can be generated through the deflection of the membrane, and thus the sound waves are detected. Alternatively or in addition, the piezoelectric layer is advantageously electrically decoupled from the support layer. At this, the decoupling takes place through an insulating layer arranged between the piezoelectric layer and the support layer.

It is advantageous if the multi-layer structure features two piezoelectric layers. Each of these is preferably arranged between two electrode layers. At this, one of the electrode layers, in particular four electrode layers, may be formed by the support layer. The support layer is preferably made of a metal, in particular copper. If the structure features multiple piezoelectric layers, the structure can generate more force and bring about greater deflection. In this connection, it is additionally advantageous if the structure features more than two piezoelectric layers.

It is advantageous if a piezoelectric layer of the structure is designed as a sensor and another piezoelectric layer is designed as an actuator. Alternatively, a piezoelectric layer may also comprise a multiple number of areas separate of each other, of which one area is designed as a sensor and another area is designed as an actuator.

In order to be able to detect an electrical signal upon a deflection of the piezoelectric layer and/or to be able to actively deflect the piezoelectric layer by applying a voltage, the piezoelectric layer is preferably arranged between two electrode layers. At this, the support layer forms one of such two electrode layers.

It is advantageous if the structure features a central area, to which a coupling element is attached. The coupling element and the printed circuit board are preferably made of the same material, in particular a fiber composite material. The coupling element can be connected to the membrane provided for this purpose, such that it can be deflected as a result of a lifting movement of the structure in the z-direction, or along the lifting axis.

An additional advantage is that the structure features an actuator/sensor area. In each case, such area is arranged between the anchoring area and the central area. In addition or alternatively, the actuator/sensor area is connected to the central area by means of at least one flexible connecting element. The voltage generated by the piezoelectric effect can be detected by the sensor system and made available for evaluation, such that the actual position of the membrane can be determined in a simple manner. Through the actuator/sensor area, different geometries can be formed to efficiently control different areas and vibration modes. Through the structure integrated into the printed circuit board and the actuator/sensor area, the performance and sound quality of the sound transducer assembly can be increased without an additional need for space.

An ASIC is advantageously embedded in the printed circuit board in a completely encapsulated manner. Alternatively or in addition, additional electrical components are embedded in the printed circuit board in a completely encapsulated manner. The functionality of the sound transducer assembly can be produced without additional support material. The ASIC or the additional electrical components can be integrated into the manufacturing process in the printed circuit board and connected to the associated components by means of plated through-holes.

An additional advantage is that the printed circuit board features at least one external contact for an electrical connection to an external device. At this, the external contact is arranged in a manner freely accessible on an outer side of the printed circuit board module.

A sound transducer assembly for generating and/or detecting sound waves in the audible wavelength spectrum is also proposed. The sound transducer assembly features a membrane, a cavity and a MEMS printed circuit board module. The MEMS circuit board module comprises a multi-layer piezoelectric structure. By means of the piezoelectric structure, the membrane is set into oscillation. Alternatively or in addition, oscillations of the membrane can be detected by means of the structure. The MEMS circuit board module is formed according to the preceding description, whereas the specified features may be present individually or in any combination.

Through the structure integrated into the printed circuit board, the sound transducer assembly can be manufactured inexpensively. The structure, in particular its support layer, can be easily embedded in the printed circuit board during the layered production, and can be connected to the required electronic components. As a result, different types of printed circuit boards can be realized in a simple manner.

Advantageously, the membrane is connected in its edge area directly to the printed circuit board. Alternatively, it is advantageous if the sound transducer assembly includes a membrane module. The membrane module features the membrane and a membrane frame. The membrane frame holds the membrane in its edge area. In addition or alternatively, the membrane module is connected to the MEMS printed circuit board module by means of the membrane frame. The modular construction of the sound transducer assembly makes it possible to, prior to assembly, test the individual modules, in particular the MEMS printed circuit board module and the membrane module, for their functionality, independently of each other Through the sound transducer assembly according to the invention, faulty modules can be identified early, such that the number of defective systems can be reduced in this manner.

An additional advantage is that the cavity is at least partially formed by a recess of the printed circuit board. Alternatively or in addition, the cavity is formed by a housing part, in particular one made of metal or plastic. The housing part is preferably connected to the MEMS printed circuit board module on the side turned away from the membrane module. The cavity can be rapidly, easily and inexpensively adjusted to the particular application, without having to change the printed circuit board.

The membrane advantageously features a reinforcing element, in particular a multi-layer reinforcing element. Through the reinforcing element, the sensitive membrane is protected from damages caused by excessive movement of the membrane due to excessive sound pressure or external vibrations or shock. Alternatively or in addition, the membrane is connected in an inner connection area to a coupling element of the MEMS printed circuit board module. Through the structure, a lifting movement can be generated, by means of which the membrane can be deflected.

A Manufacturing method for a MEMS printed circuit board module and/or a sound transducer assembly is also proposed. The MEMS circuit board module and the sound transducer assembly are formed according to the preceding description, whereas the specified features may be present individually or in any combination. With the proposed manufacturing method, a multi-layer printed circuit board is manufactured. For this purpose, at least one metallic conductive layer and a multiple number of printed circuit board support layers are connected to each other by means of lamination. At this, the printed circuit board support layers are made in particular from fiber composite material. A multi-layer piezoelectric structure is formed and connected directly and firmly to the printed circuit board in an anchoring area turned towards the printed circuit board by means of lamination. Thus, a piezoelectric layer of the structure is laminated into the multi-layer printed circuit board, in particular directly on the conductive layer.

Thus, the layered structure of printed circuit boards made of copper foil and conductor plate support layers, in particular support material, can be easily and inexpensively connected to the manufacturing of the structure. In this manner, all components embedded in the printed circuit board that are necessary for functionality can be easily contacted to each other. For this purpose, only the individual conductive layers must be connected by means of plated through-holes through the manufacturing method according to the invention. Likewise, the printed circuit board geometry can be inexpensively adjusted to individual applications.

BRIEF DESCRIPTION OF THE DRAWINGS

Further advantages of the invention are described in the following embodiments. The following is shown.

In the following description of the figures, in order to define the relationships between the various elements, with reference to the locations of objects shown in the figures, relative terms, such as above, below, up, down, over, left, right, vertical or horizontal are used. It is self-evident that such a term may change in the event of a deviation from the location of the devices and/or elements shown in the figures. Accordingly, for example, in the case of an orientation of a device and/or an element shown inverted with reference to the figures, a characteristic that has been specified as "above" in the following description of the figures would now be arranged "below." Thus, the relative terms are used solely for a more simple description of the relative relationships between the individual devices and/or elements described below.

DETAILED DESCRIPTION

Figure 1:
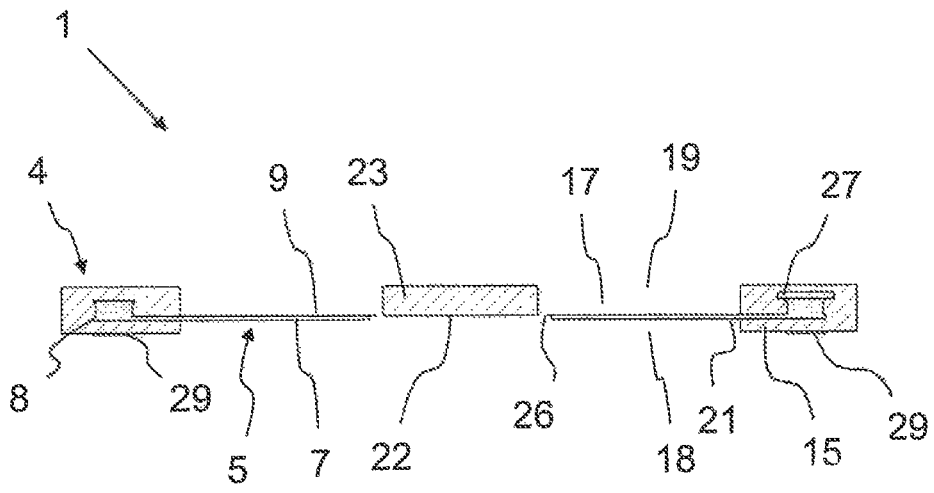
FIG. 1 a MEMS printed circuit board module in a side view.

FIG. 1 shows a MEMS printed circuit board module 1 in a sectional view. The MEMS circuit board module 1 is provided for a sound transducer assembly 2 (see FIGS. 6 and 7) for generating and/or detecting sound waves in the audible wavelength spectrum. The MEMS printed circuit board module 1 essentially comprises a printed circuit board 4 and a multi-layer structure 5, in particular a piezoelectric structure 5. The printed circuit board 4 is a multi-layer composite fiber component with at least one electrical conductive layer 8 made of metal. The printed circuit board 4 comprises an ASIC 27 (FIG. 1) and/or passive electronic additional components 28 (FIG. 2), which are completely integrated into the printed circuit board 4. Thus, the ASIC 27 and/or the passive electronic additional components 28 are completely encapsulated by the printed circuit board 4.

Figure 2:
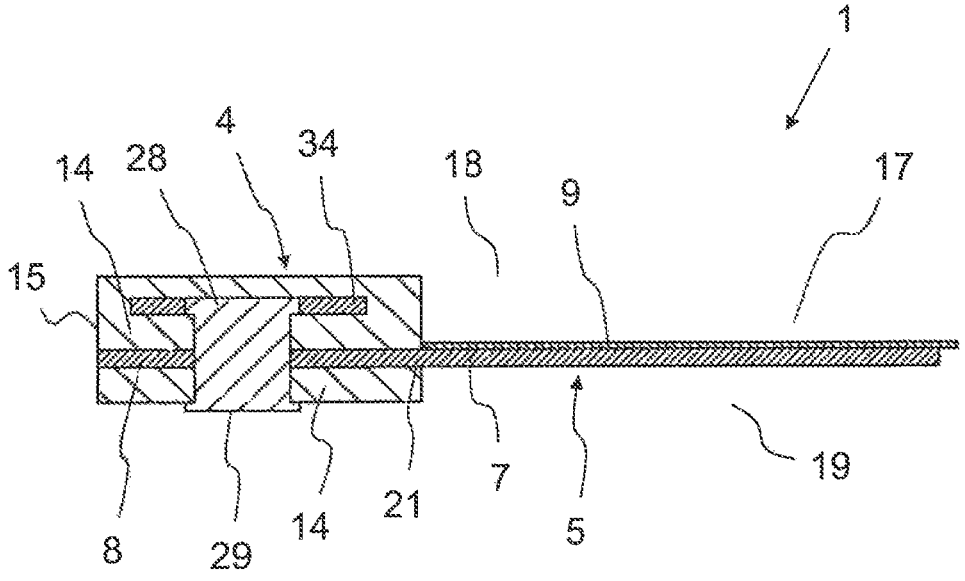
FIG. 2 a detailed section of the MEMS printed circuit board module according to FIG. 1 in the connection area between a piezoelectric structure and a printed circuit board, FIG. 3 an additional embodiment of the MEMS printed circuit board module in a detailed section, FIG. 4 a schematic detailed view of a piezoelectric structure, FIG. 5 a second embodiment of a piezoelectric structure in a schematic detailed view, FIG. 6 a sound transducer assembly in a sectional view, FIG. 7 a second embodiment of a sound transducer assembly in a sectional view, FIG. 8 a third embodiment of a piezoelectric structure with an actuator/sensor area in a top view.

As shown in FIGS. 1 and 2, the printed circuit board 4 defines a recess 17 with a first opening 18 and a second opening 19 opposite the first opening 18. Thus, the recess 17 extends completely through the printed circuit board 4 from the first opening 18 to the second opening 19. The recess 17 is a through-hole, such that the printed circuit board 4 is formed as a circumferentially closed frame, in particular as a support frame 15. In addition to the ASIC 27 and the additional components 28, the structure 5, in particular in an anchoring area 21, is also integrated into such support frame 15.

The structure 5 is connected directly to the printed circuit board 4 in the interior of the recess 17. Accordingly, the printed circuit board 4 forms a structural support, which supports the piezoelectric structure 5 and with respect to which the structure 5 can be deflected. The piezoelectric structure 5 features a support layer 7 and a piezoelectric functional region 9. In its outer area, the structure 5 features the anchoring area 21. In such anchoring area 21 facing towards the printed circuit board 4, the structure 5 is firmly connected to the printed circuit board 4, in particular the conductive layer 8. At this, the conductive layer 8 essentially forms the support layer 7 of the piezoelectric structure 5, which is integrated into the printed circuit board 4 in this manner.

In addition, the structure 5 includes a central region 22, which is substantially arranged centrally in the interior of the recess 17. In this central region 22, the structure 5 is connected to a coupling element 23 through at least one flexible connecting element 26. The coupling element 23 and the printed circuit board 4 are preferably made of the same material, in particular a fiber composite material. The structure 5 can deflect the coupling element 23 relative to the printed circuit board 4 in the z-direction or along the lifting axis from the neutral position shown in FIG. 1.

Figure 6:
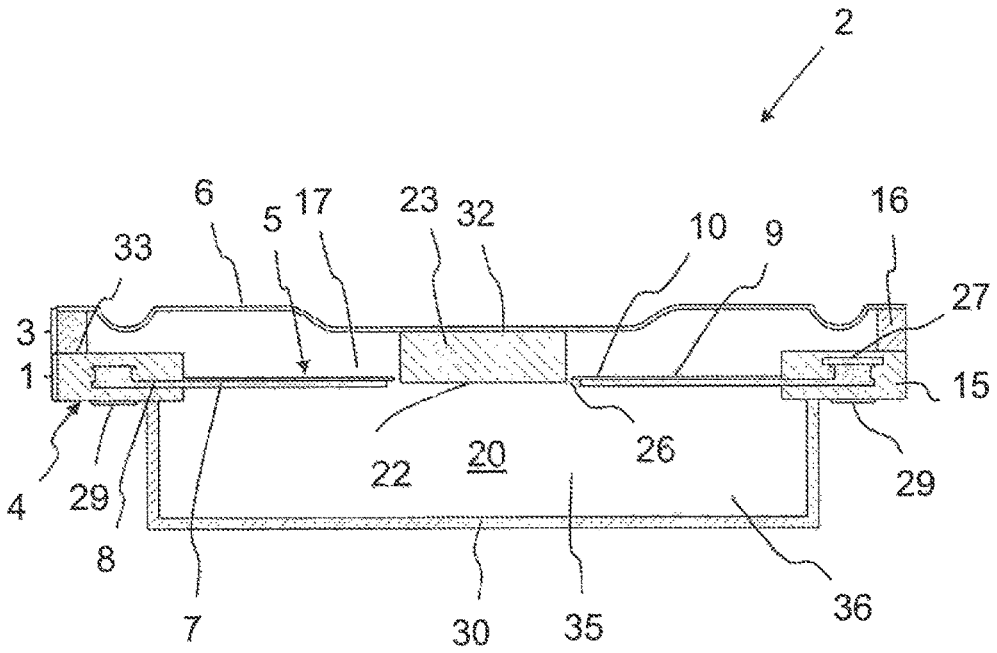
Figure 7:
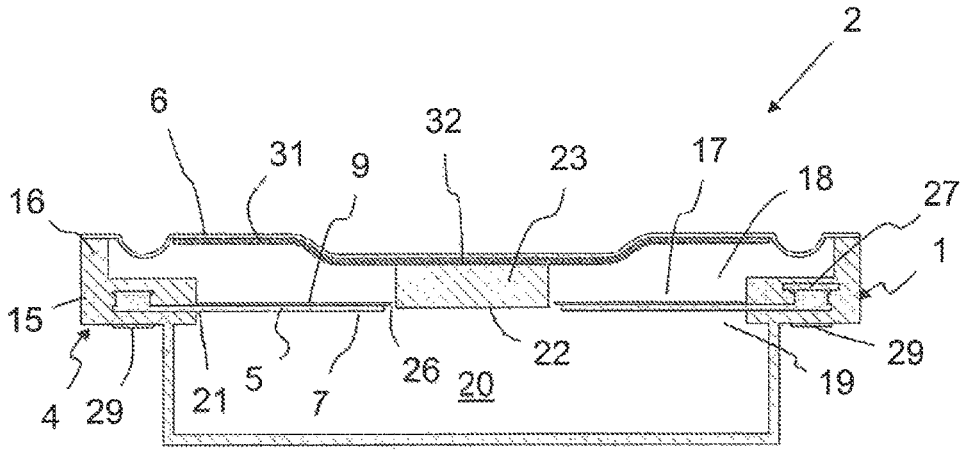

The recess 17 at least partially forms a cavity 20 of the sound transducer assembly 2, which is shown in full in FIGS. 6 and 7. The printed circuit board 4 also includes an external contact 29 for the electrical connection to an external device, which is not shown here.

FIG. 2 shows a detailed section of the MEMS printed circuit board module 1 according to FIG. 1 in cross-section, in particular in the connection area between the printed circuit board 4 and the piezoelectric structure 5. The multilayer printed circuit board 4 is a laminated fiber composite component, which features at least a first conductive layer 8 and a second conductive layer 34. The two conductive layers 8, 34 are electrically decoupled from each other through printed circuit board support layers 14. The structure 5 is connected to the printed circuit board 4 in its anchoring area 21. At this, the first conductive layer 8 of the printed circuit board 4 forms the support layer 7 of the structure 5. The piezoelectric functional region 9 (see FIGS. 4 and 5) is supported by the support layer 7.

The support layer 7 is laminated in the printed circuit board 4 and thus directly connected to it. The functional area 9 is firmly connected to the printed circuit board 4 by means of the support layer 7. The functional layer 9 can be laminated on the support layer 7.

External devices can be connected to the sound transducer assembly 2 through an external contact 29, which is arranged on one side of the printed circuit board 4. For this purpose, the printed circuit board 4 in the area of the second conductive layer 34 includes the additional components 28 or the ASIC 27 (see FIG. 3), as the case may be, which are indicated only schematically in FIG. 2.

Figure 3:
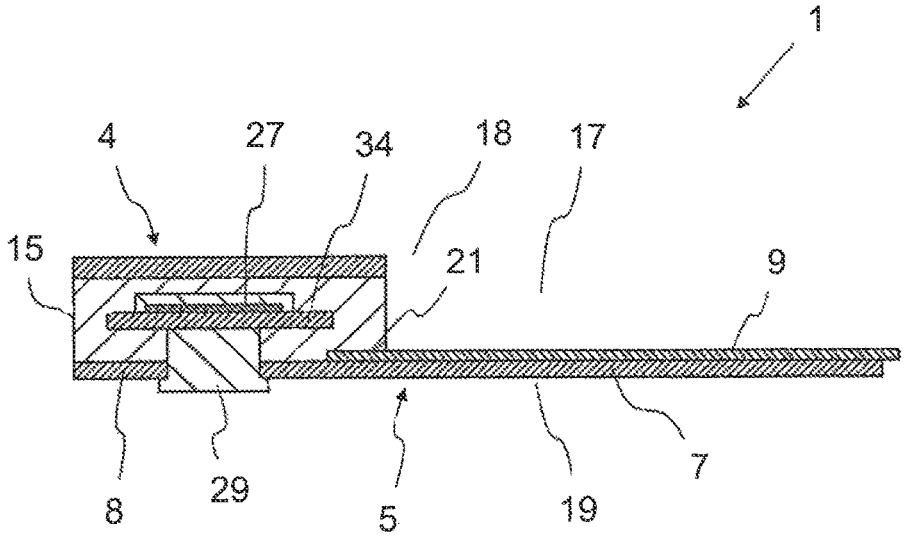

FIG. 3 shows an additional embodiment of the MEMS printed circuit board module 1, whereas the following essentially addresses the differences with respect to the embodiment already described. Thus, with the following description, the additional embodiments for the same characteristics use the same reference signs. To the extent that these are not explained once again in detail, their design and mode of action correspond to the characteristics described above. The differences described below can be combined with the characteristics of the respective preceding and subsequent embodiments.

FIG. 3 shows the MEMS printed circuit board module 1 in a detailed section, whereas the piezoelectric structure 5 is arranged not inside the recess 17, but in the area of the second opening 19. At this, the first conductive layer 8 is connected directly to the support layer 7. It would also be conceivable to connect the piezoelectric structure 5 to the printed circuit board 4 in the area of the first opening 18. The functional area 9 is at least partially embedded in the printed circuit board 4 and is supported by the support layer 7 in the area of the second opening 19. Accordingly, the printed circuit board 4 forms a structural support, which supports the piezoelectric structure 5 and with respect to which the piezoelectric structure 5 can be deflected.

The second conductive layer 34 shown in FIG. 3 is connected to the ASIC 27. The ASIC 27 constitutes an encapsulated control unit, which is electrically connected to the second conductive layer 34. In the illustrated embodiment, the ASIC 27 is encapsulated in a hollow space of the printed circuit board 4. However, alternatively or in addition, the ASIC 27 may also be coated or cast with synthetic resin. Like the ASIC 27, the additional electrical component 28 may be coupled to one of the conductive layers 8, 34.

Figure 4:
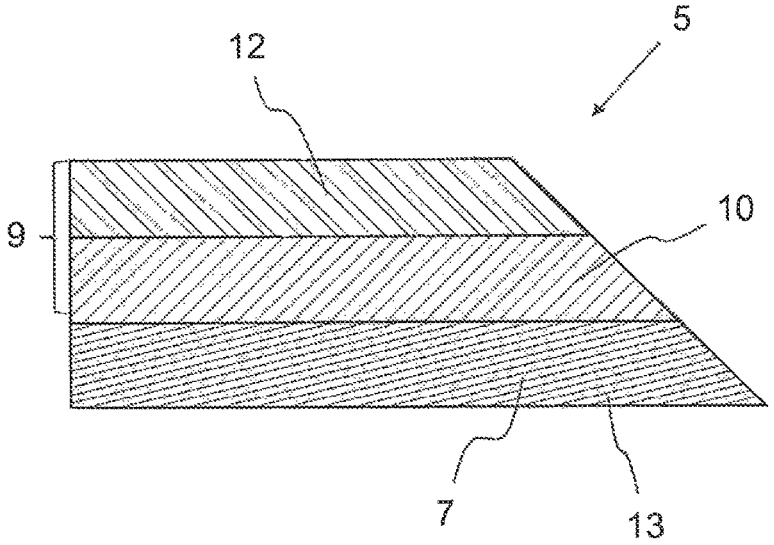

FIG. 4 shows a detailed view of the piezoelectric structure 5. The structure 5 features the support layer 7 and the functional area 9. The functional area 9 comprises a piezoelectric layer 10, which preferably consists of lead zirconate titanate (PZT) and/or aluminum nitride (ALN). In order to be able to detect an electrical signal upon a deflection of the piezoelectric layer 10 and/or to be able to actively deflect the piezoelectric layer 10 through the application of voltage, the piezoelectric layer 10 is embedded between an upper electrode layer 12 and a lower electrode layer 13. At this, the support layer 7 of the printed circuit board 4 forms the lower electrode layer 13, whereas the piezoelectric structure 5 is embedded or integrated directly into the printed circuit board 4 through this configuration.

Figure 5:
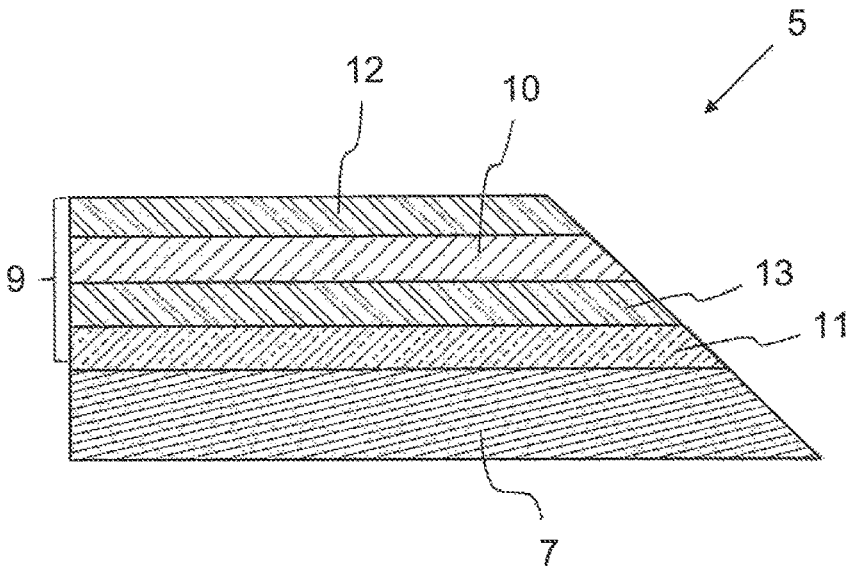

FIG. 5 shows an additional embodiment of the piezoelectric structure 5. According to the piezoelectric structure 5 illustrated in FIG. 4, this embodiment includes a piezoelectric layer 10 that is sandwiched between two electrode layers 12, 13. This three-layer combination constitutes the basis for the embodiment described below. With the following description of this embodiment, the same reference signs are used for the same features in comparison with the embodiment shown in FIG. 4. Unless they are once again explained, their design and mode of action corresponds to the features already described above.

According to the embodiment illustrated in FIG. 5, the piezoelectric structure 5 includes, in addition to the two electrode layers 12, 13 and the piezoelectric layer 10, an insulating layer 11, which is formed in particular from silicon oxide. In this embodiment, the lower electrode layer 13 is not formed by the support layer 7 of the printed circuit board 4 itself, but by an additional layer in the functional area 9. Through the insulating layer 11, the lower electrode layer 13 is electrically decoupled from the support layer 7.

FIG. 6 shows a first embodiment of the sound transducer assembly 2 in a sectional view. The sound transducer assembly 2 comprises the MEMS printed circuit board module 1, the membrane 6 and the membrane frame 16. The membrane 6 has a region that is free to move in the z-direction or along the lifting axis in an oscillating manner with respect to the membrane frame 16. The membrane 6 and the membrane frame 16 essentially form a membrane module 3. In its outer frame area, the printed circuit board 4 is connected to an outer connection area 33 of the membrane module 3, in particular to the membrane frame 16. An inner connection area 32 is formed between the membrane 6 and the coupling element 23. Thus, the membrane 6 spans the membrane frame 16 and is stiffened in its central area where the interconnection area 32 is defined.

The recess 17 shown in FIG. 6 at least partially forms a cavity 20 of the sound transducer assembly 2. The cavity 20 is closed by a housing part 30 on the side of the MEMS printed circuit board module 1 facing away from the membrane frame 16. The housing part 30 is formed from metal or plastic and defines in the interior of the housing part 30 a housing hollow space 35, which combines with the recess 17 to form the cavity 20. The size of the housing housing space 35 can be selected depending on the sound pressure to be generated.

The piezoelectric structure 5 is arranged below the membrane 6 and/or substantially parallel to it. The support layer 7 of the piezoelectric structure 5 is directly connected to one of the conductive layers 8, 34 of the printed circuit board 4, and can be deflected relative to the printed circuit board 4 in the z-direction. The piezoelectric layer 10 is designed to produce a uni-directional or bidirectional lifting movement of the piezoelectric structure 5 for the deflection of the membrane 6. Accordingly, the piezoelectric layer 10 works together with the membrane 6 in order to convert electrical signals into acoustically perceptible sound waves. Alternatively, the acoustically perceptible sound waves can be converted into electrical signals.

The structure 5 is connected to the ASIC 27 by means of contacts not shown in the figures. Thus, the sound transducer assembly 2 can be controlled or operated via the ASIC 27, such that, for example through the piezoelectric structure 5, the membrane 6 can be set into oscillation relative to the membrane frame 16 in order to produce sound energy.

FIG. 7 shows an additional embodiment of the sound transducer assembly 2, whereas the following essentially addresses the differences with respect to the embodiment already described. Thus, with the following description, the additional embodiments for the same characteristics use the same reference signs. Unless they are once again explained in detail, their design and mode of action corresponds to the features already described above. The differences described below can be combined with the features of the respective preceding and following embodiments.

A reinforcing element 31, which itself is not connected to the membrane frame 16, is arranged on a bottom surface of the membrane 6, in particular in its middle area. Thus, the reinforcing element 31 can oscillate together with the membrane 6 with respect to the membrane frame 16 in the z-direction. In addition, the inner connection area 32 of the membrane 6 is stiffened in this manner. In this embodiment, the membrane frame 16 is formed from the printed circuit board 4 itself and therefore of the same material. Thus, the membrane frame 16 and the printed circuit board 4 are formed in one piece.

According to FIG. 7, the sound transducer assembly 2 does not feature any separate housing parts 30. Here, the cavity 20 is formed and closed by the printed circuit board 4 itself. However, a design of the membrane frame 16 according to the first embodiment of the sound transducer assembly 2 is likewise conceivable.

Figure 8:
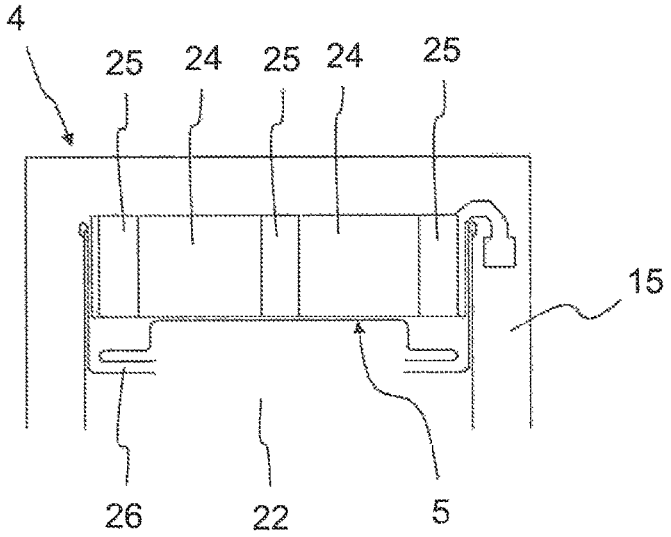

FIG. 8 shows a third embodiment of a piezoelectric structure 5 in a top view. The piezoelectric structure 5, which is designed in particular as a cantilever, includes at least one actuator region 24 and one sensor region 25. The actuator I sensor region 24, 25 is arranged between the anchoring area 21 and the central area 22. The connection to the central area 22 takes place by means of at least one flexible connecting element 26. At this, the sensor region 25 is preferably designed as a position sensor in order to provide the ASIC 27 with a sensor signal that is dependent on the membrane deflection. In doing so, the elastic oscillation properties of the connecting element 26 are taken into account. The voltage generated via the piezoelectric effect, which is approximately proportional to the deflection of the region structure 5, is tapped and evaluated via the electrode layers 12, 13 (compare FIGS. 4 and 5). Based on the control signal, the region structure 5 can be driven in a controlled manner by the ASIC 27.

The sensor region 25 and the actuator region 24 are formed by a common piezoelectric layer 10. At this, at least one area is a sensor region 25, by means of which two actuator regions 24 are spaced apart from each other. The actuator regions 24 are electrically isolated from each other. The two regions 24, 25 may be formed from material different from each other, in particular from lead zirconate titanate or aluminum nitride.

This invention is not limited to the illustrated and described embodiments. Variations within the scope of the claims, just as the combination of characteristics, are possible, even if they are illustrated and described in different embodiments.

LIST OF REFERENCE SIGNS

1 1 MEMS printed circuit board module
2 Sound transducer assembly
3 Membrane module
4 Circuit board
5 Structure
6 Membrane
7 Support layer
8 First conductive layer
9 Functional region
10 Piezoelectric layer
11 Insulating layer
12 Upper electrode layer
13 Lower electrode layer
14 Printed circuit board support layers
15 Support frame
16 Membrane frame
17 Recess
18 First opening
19 Second opening
20 Cavity
21 Anchoring area
22 Central region
23 Coupling element
24 Actuator region
25 Sensor region
26 Connecting element
27 ASIC
28 Additional components
29 External contact
30 Housing part
31 Reinforcing element
32 Inner connection area
33 Outer connection area
34 Second conductive layer
35 Housing hollow space

The invention claimed is:

1. MEMS printed circuit board module for a sound transducer assembly for generating in a membrane and/or detecting from the membrane, sound waves in the audible wavelength spectrum, the MEMS printed circuit board module comprising:

a printed circuit board; and a multi-layer piezoelectric structure that is configured for setting the membrane into oscillation to generate oscillations that can be detected by the printed circuit board; and wherein the multi-layer piezoelectric structure defines an anchoring area facing towards the printed circuit board, and the printed circuit board is laminated to the anchoring area of the multi-layer piezoelectric structure; and wherein the printed circuit board defines a recess within which the multi-layer piezoelectric structure is disposed.

2. MEMS printed circuit board module according to claim 1, wherein the printed circuit board defines a support frame for the multi-layer piezoelectric structure.

3. MEMS printed circuit board module according to claim 1, wherein the printed circuit board defines a recess that completely extends through the printed circuit board and defines an opening of the recess, whereas the multi-layer piezoelectric structure is disposed at the opening of the recess.

4. MEMS printed circuit board module according to claim 1, wherein the recess completely extends through the printed circuit board.

5. MEMS printed circuit board module according claim 1, wherein the anchoring area of the multi-layer piezoelectric structure is embedded in the printed circuit board.

6. MEMS printed circuit board module according to claim 1, wherein the multi-layer piezoelectric structure is an actuator structure and includes a support layer made of metal having a thickness of 1 to 50 μm.

7. MEMS printed circuit board module according to claim 1, wherein the multi-layer piezoelectric structure is a sensor structure and includes a support layer made of metal having a thickness of 1 to 50 μm.

8. MEMS printed circuit board module according to claim 1, wherein the printed circuit board is a laminated fiber composite component and includes an electrical conductive layer made of metal, which forms a support layer for the multi-layer piezoelectric structure.

9. MEMS printed circuit board module according to claim 8, wherein the multi-layer piezoelectric structure includes a piezoelectric layer, which is electrically coupled to the support layer.

10. MEMS printed circuit board module according to claim 9, wherein the piezoelectric layer is disposed between two electrode layers, and wherein the support layer forms one of the two electrode layers.

11. MEMS printed circuit board module according to claim 9, further comprising an insulating layer disposed in between the support layer and the piezoelectric layer, wherein the a piezoelectric layer is electrically decoupled from the support layer.

12. MEMS printed circuit board module according to claim 1, further comprising a coupling element made of fiber composite material, wherein the multi-layer piezoelectric structure defines a central area attached to the coupling element, and wherein the printed circuit board is made of fiber composite material.

13. MEMS printed circuit board module according to claim 1, further comprising an ASIC embedded in the printed circuit board in a completely encapsulated manner.

14. Sound transducer assembly for generating and/or detecting sound waves in the audible wavelength spectrum, comprising:

a membrane; a printed circuit board; and a multi-layer piezoelectric structure that is configured for setting the membrane into oscillation to generate oscillations that can be detected by the printed circuit board; and wherein the multi-layer piezoelectric structure defines an anchoring area facing towards the printed circuit board, and the printed circuit board is laminated to the anchoring area of the multi-layer piezoelectric structure; and wherein the printed circuit board defines a recess within which the multi-layer piezoelectric structure is disposed.

15. Sound transducer assembly according to claim 14, wherein the membrane defines an edge area that is connected directly to the printed circuit board.

16. Sound transducer assembly according to claim 14, further comprising a membrane frame, wherein the membrane defines an edge area that is connected directly to the membrane frame, which is connected to the MEMS printed circuit board.

17. Sound transducer assembly according to claim 14, further comprising a membrane frame, wherein the membrane defines an edge area that is directly held to the membrane frame.

18. Sound transducer assembly according to claim 17, wherein the printed circuit board defines a recess that forms part of a cavity that is disposed to face away from the membrane frame.

19. Sound transducer assembly according to claim 17, further comprising a housing part made of metal or plastic, which is connected to the MEMS printed circuit board module on the side turned away from the membrane, wherein the housing part defines a recess that forms part of a cavity that is disposed to face away from the membrane frame.

20. MEMS printed circuit board module according claim 1, wherein the printed circuit board is a laminated multi-layer printed circuit board.

* * * * *